US008911277B2

(12) United States Patent
Garbos et al.

(10) Patent No.: US 8,911,277 B2
(45) **Date of Patent: *Dec. 16, 2014**

(54) CONTEXT-BASED INTERACTIVE PLUSH TOY

(75) Inventors: Jennifer R. Garbos, Kansas City, MO (US); Timothy G. Bodendistel, Lenexa, KS (US); Peter B. Friedmann, Westwood, KS (US)

(73) Assignee: Hallmark Cards, Incorporated, Kansas City, MO (US)

( * ) Notice: Subject to any disclaimer, the term of this patent is extended or adjusted under 35 U.S.C. 154(b) by 63 days.

This patent is subject to a terminal disclaimer.

(21) Appl. No.: 13/116,927

(22) Filed: May 26, 2011

(65) Prior Publication Data

US 2011/0223827 A1 Sep. 15, 2011

Related U.S. Application Data

(63) Continuation of application No. 12/625,977, filed on Nov. 25, 2009, now Pat. No. 8,568,189.

(51) Int. Cl.
*A63H 30/00* (2006.01)
*A63H 33/38* (2006.01)
*A63H 3/28* (2006.01)

(52) U.S. Cl.
CPC ..... *A63H 3/28* (2013.01); *A63H 33/38* (2013.01); *A63H 2200/00* (2013.01)
USPC ..... 446/175; 446/184; 446/242; 446/270; 446/397

(58) Field of Classification Search
USPC ..... 446/175
See application file for complete search history.

(56) References Cited

U.S. PATENT DOCUMENTS

| | | | | |
|---|---|---|---|---|
| 4,799,171 | A | 1/1989 | Cummings et al. | |
| 4,840,602 | A * | 6/1989 | Rose | 446/175 |
| 4,846,693 | A * | 7/1989 | Baer | 434/308 |
| 4,923,428 | A * | 5/1990 | Curran | 446/175 |
| 5,389,917 | A | 2/1995 | LaManna et al. | |
| 5,655,945 | A | 8/1997 | Jani et al. | |
| 5,657,380 | A | 8/1997 | Mozer | |
| 5,790,754 | A | 8/1998 | Mozer et al. | |

(Continued)

FOREIGN PATENT DOCUMENTS

| | | |
|---|---|---|
| DE | 19617129 | 10/1997 |
| DE | 19617132 | 10/1997 |

OTHER PUBLICATIONS

UK Search Report dated Feb. 18, 2011 re Appln. GB1019162.5,19 pages.

(Continued)

*Primary Examiner* — Tramar Harper
(74) *Attorney, Agent, or Firm* — Shook, Hardy & Bacon, L.L.P.

(57) ABSTRACT

An interactive toy for interacting with a user while a story is being read aloud from a book or played from a movie/video. The toy includes a speech recognition unit that receives and detects certain triggering phrases as they are read aloud or played from a companion literary work. The triggering phrase read aloud from the book or played in the movie/video may have independent significance or may only have significance when combined with other phrases read aloud from the book or played in the movie/video.

12 Claims, 10 Drawing Sheets

(56) References Cited

U.S. PATENT DOCUMENTS

| | | | | |
|---|---|---|---|---|
| 5,795,213 | A * | 8/1998 | Goodwin | 446/297 |
| 5,930,757 | A | 7/1999 | Freeman | |
| 6,021,387 | A | 2/2000 | Mozer et al. | |
| 6,405,167 | B1 * | 6/2002 | Cogliano | 704/251 |
| 6,665,639 | B2 | 12/2003 | Mozer et al. | |
| 6,697,602 | B1 * | 2/2004 | Ferrigno et al. | 434/308 |
| 6,773,344 | B1 | 8/2004 | Gabai et al. | |
| 6,810,379 | B1 | 10/2004 | Vermeulen | |
| 6,832,194 | B1 | 12/2004 | Mozer et al. | |
| 6,999,927 | B2 | 2/2006 | Mozer et al. | |
| 7,062,073 | B1 | 6/2006 | Tumey et al. | |
| 7,092,887 | B2 | 8/2006 | Mozer et al. | |
| 7,248,170 | B2 | 7/2007 | DeOme et al. | |
| 7,252,572 | B2 | 8/2007 | Wright et al. | |
| 7,418,392 | B1 | 8/2008 | Mozer et al. | |
| 7,487,089 | B2 | 2/2009 | Mozer | |
| 7,720,683 | B1 | 5/2010 | Vermeulen et al. | |
| 7,774,204 | B2 | 8/2010 | Mozer et al. | |
| 7,801,729 | B2 | 9/2010 | Mozer | |
| 7,940,168 | B2 | 5/2011 | Needham et al. | |
| 8,070,628 | B2 | 12/2011 | Denton et al. | |
| 2002/0028704 | A1 | 3/2002 | Bloomfield et al. | |
| 2002/0107591 | A1 | 8/2002 | Gabai et al. | |
| 2003/0162475 | A1 * | 8/2003 | Pratte et al. | 446/175 |
| 2005/0105769 | A1 | 5/2005 | Sloan | |
| 2005/0154594 | A1 | 7/2005 | Beck | |
| 2006/0057545 | A1 | 3/2006 | Mozer et al. | |
| 2006/0127866 | A1 * | 6/2006 | Damron et al. | 434/236 |
| 2006/0234602 | A1 | 10/2006 | Palmquist | |
| 2007/0093169 | A1 * | 4/2007 | Blaszczyk et al. | 446/147 |
| 2007/0128979 | A1 | 6/2007 | Shackelford et al. | |
| 2007/0132551 | A1 | 6/2007 | Mozer et al. | |
| 2007/0298893 | A1 | 12/2007 | Yu et al. | |
| 2008/0140413 | A1 * | 6/2008 | Millman et al. | 704/270 |
| 2008/0152094 | A1 | 6/2008 | Perlmutter | |
| 2008/0267364 | A1 | 10/2008 | Janke et al. | |
| 2008/0275699 | A1 | 11/2008 | Mozer | |
| 2008/0304360 | A1 | 12/2008 | Mozer | |
| 2009/0094032 | A1 | 4/2009 | Mozer | |
| 2009/0094033 | A1 | 4/2009 | Mozer et al. | |
| 2009/0132255 | A1 | 5/2009 | Lu | |
| 2009/0150160 | A1 | 6/2009 | Mozer | |
| 2009/0204409 | A1 | 8/2009 | Mozer et al. | |
| 2009/0204410 | A1 | 8/2009 | Mozer et al. | |
| 2010/0028843 | A1 * | 2/2010 | Currington et al. | 434/317 |
| 2011/0223827 | A1 | 9/2011 | Garbos et al. | |

OTHER PUBLICATIONS

UK Search Report dated Oct. 26, 2011 re Appln. GB1114654.5, 6 pages.

Canadian Office Action dated Nov. 13, 2012 re Appln. 2686061, 3 pages.

Hasbro, Shrek 2 Talking Donkey, Talking Shrek, Talking Puss in Boots Instruction Manual, 2003.

Hasbro, Shrek 2 Wise-Crackin' Donkey Instruction Manual, 2003.

Office Action, dated Jan. 11, 2013 re U.S. Appl. No. 12/625,977, 31 pages.

Notice of Allowance re U.S. Appl. No. 12/625,977, dated Apr. 29, 2013, 18 pages.

PCT Search Report and Written Opinion dated Mar. 10, 2014 re PCT/US2013/064847, 15 pages.

* cited by examiner

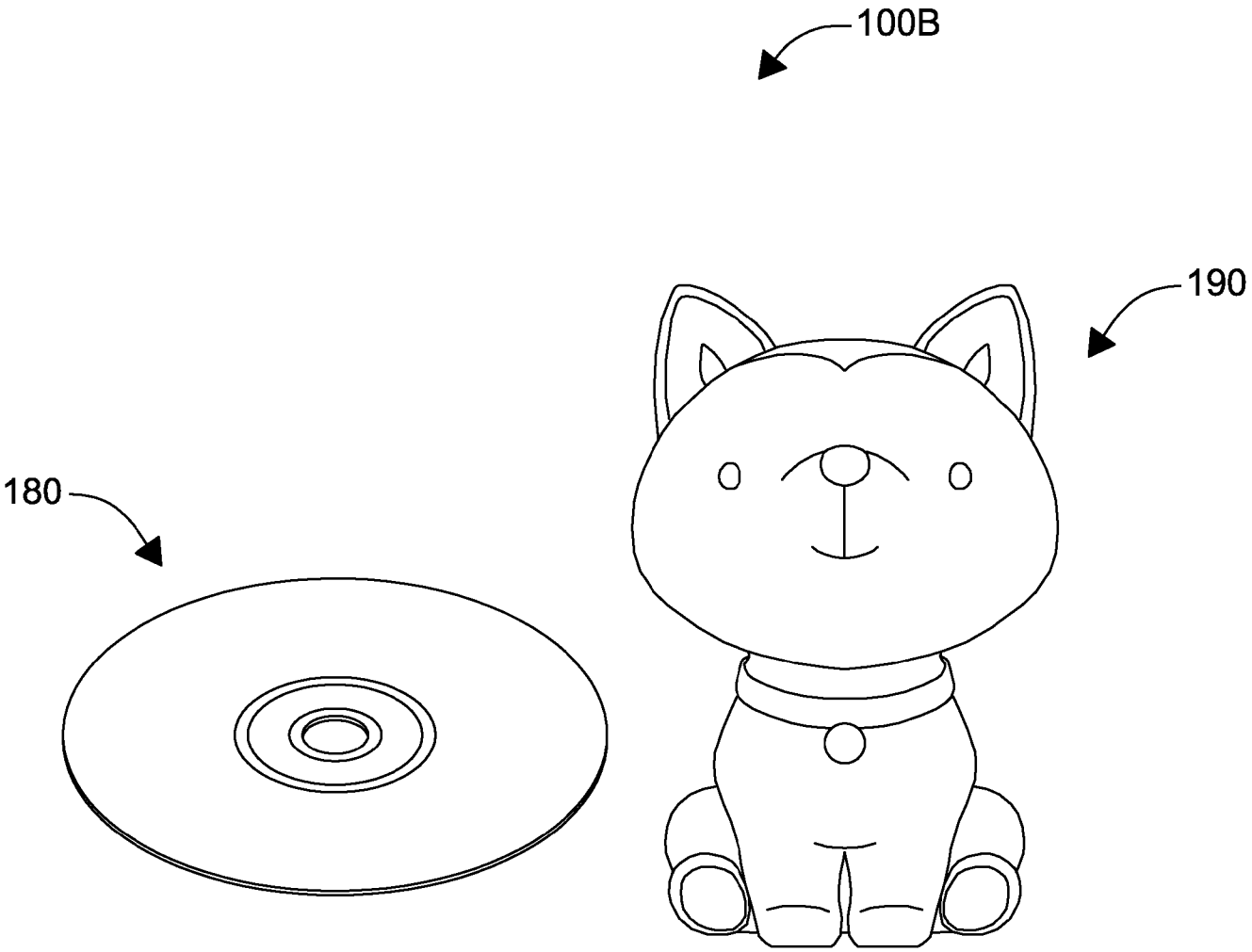
FIG. IB

CONTEXT-BASED INTERACTIVE PLUSH TOY

CROSS-REFERENCE TO RELATED APPLICATIONS

This application is a continuation of U.S. application Ser. No. 12/625,977, filed Nov. 25, 2009, which is hereby incorporated by reference in its entirety.

STATEMENT REGARDING FEDERALLY SPONSORED RESEARCH OR DEVELOPMENT

Not applicable.

BRIEF SUMMARY OF THE INVENTION

The present invention relates to an interactive toy. More particularly, this invention relates to a toy having electronic components therein to activate an interactive program in response to a context-based prompt or set of context-based prompts.

The toy includes a body having an interior cavity (or cavities) in which the electrical components are concealed. A user engagable activation switch is provided to initiate interaction with the toy. In one embodiment, the toy is programmed to receive and interpret spoken words and, depending on the analysis, provide a specific response.

In another embodiment, the spoken words are provided to the user as part of a literary work, such as, for example, a book. In this embodiment, the user reads the book aloud and the toy receives the spoken words and analyzes them. When a triggering phrase or set of phrases is detected, the toy activates a pre-programmed response. The triggering phrases of the current invention are included as part of the literary work and, in some embodiments, the user does not even known what phrases will trigger the response. In other embodiments, the triggering phrases are differentiated from surrounding text such that the user will know when a triggering phrase is about to be read aloud. In a different embodiment, the literary work may comprise a movie or television show. In this example, the toy is programmed to respond to certain triggering phrases that are broadcast as the movie/show is playing.

In still another embodiment of the present invention, phrases that trigger or correspond to a particular response are selectively placed within the literary work. For example, a triggering phrase could be placed at the beginning of a sentence or at the end of a page of the book. This selective placement facilitates reception and analysis of speech in a speech recognition unit positioned in the interactive toy.

Further objects, features, and advantages of the present invention over the prior art will become apparent from the detailed description of the drawings which follows, when considered with the attached figures.

BRIEF DESCRIPTION OF THE SEVERAL VIEWS OF THE DRAWINGS

The features of the invention noted above are explained in more detail with reference to the embodiments illustrated in the attached drawing figures, in which like reference numerals denote like elements, in which FIGS. 1-5 illustrate one of several possible embodiments of the present invention, and in which:

FIG. 1B is a front perspective view of an interactive toy and movie system in accordance with one embodiment of the present invention;

FIG. 2 is a front perspective view of a book of FIG. 1A having certain triggering and non-triggering phrases in accordance with one embodiment of the present invention;

DETAILED DESCRIPTION OF THE INVENTION

Figure 1A:
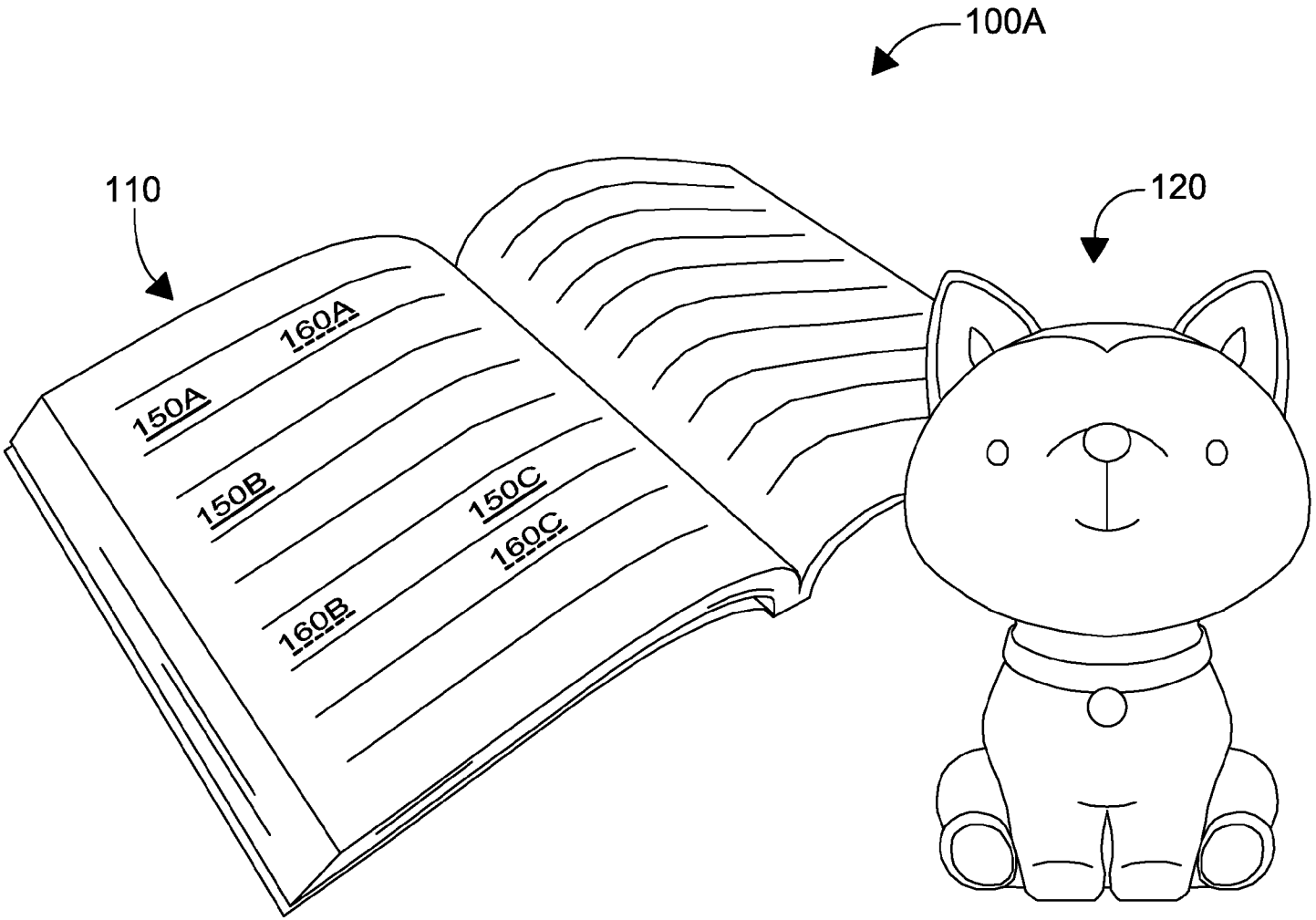
FIG. 1A is a front perspective view of an interactive toy and book system in accordance with one embodiment of the present invention.

Referring now to the drawings in more detail and initially to FIG. 1A, numeral 100A generally refers to a system in accordance with one embodiment of the present invention. In system 100A, numeral 110 designates a book, book 110 being distributed with an interactive plush toy 120 in accordance with an embodiment of the present invention. It is to be appreciated that book 110 could be any work of literature, such as, for example, a manuscript, a movie (e.g., on VHS, DVD, or any live media broadcast), a magazine (not shown), and so on. By way of further example, the work of literature in system 100A could include any live or live-action performance, such as, for example, live television programs, internet broadcasts, radio programming, and so on. Indeed, book 110 could be a greeting card with or without media functionalities. In one embodiment, book 110 does not include any special features or electronics, only carefully selected phrasing or words. That is, book 110 includes a number of phrases, some of which are triggering phrases 150, such as, triggering phrases 150*a*, 150*b*, 150*c*, and so on. As used herein, a "triggering phrase" can be any combination of words (or words occurring alone) that are programmed to elicit one or more responses in a device, such as, for example, interactive plush toy 120. The only requirement is that the phrase form a part of a narrative of a story being told. In addition to triggering phrases 150, book 110 includes other phrases, such as non-triggering phrases 160 (shown as non-triggering phrases 160*a*, 160*b*, and 160*c*). A "non-triggering phrase" is any combination of words (or words occurring alone) that is not a "triggering phrase." Like "triggering phrases," "non-triggering phrases" form a part of a narrative of a story being told. Thus, triggering phrases 150 and non-triggering phrases 160 combine to form a portion of a story being told, such as, for example, a portion of the story being told in book 110. When the story told in book 110 is read aloud by a user, the user incidentally reads both triggering phrases 150 and non-triggering phrases 160. Interactive plush toy 120, in accordance with one embodiment of the present invention, is configured to respond to triggering phrases 150 read aloud by the user. In certain embodiments, the responses activated by triggering phrases 150 are based, at least in part, by the location of triggering phrases 150 relative to other triggering phrases 150 in book 110 (e.g., response for triggering phrase 150*b* being based, at least in part, on previously detecting that a user read aloud triggering phrase 150*a*). Alternatively, the responses activated by triggering phrases 150 are based, at least in part, by the location of triggering phrases 150 relative to one or more of non-triggering phrases 160 in book 110 (e.g., response activated for triggering phrase 150*c* is optionally based, in part, on the sequence of triggering and non-triggering phrases illustrated in FIG. 1, including 160*b*, 150*c*, 160*c*). In still further embodiments, the response provided by interactive plush toy 120 coincides with the story told in book 110 and, as such, adds to or supplements the narrative included therein.

Referring now to FIG. 1B, numeral 100B generally refers to a system in accordance with one embodiment of the present invention. In system 100B, numeral 180 designates a movie, the movie 180 being distributed with an interactive plush toy 190 in accordance with an embodiment of the present invention. Alternatively, the plush toy 190 may be distributed separately, but designed to work with the movie 180. As is now clear, embodiments of the present invention encompass all types of literary works, including books and movies. As used herein, "literary works" include all works expressed in words or numbers, or other verbal or numeral symbols or indicia, regardless of the nature of the material objects, such as books, periodicals, manuscripts, phonorecords, film, tapes, and discs on which the literary works are embodied. "Literary works," thus, also includes all works that consist of a series of related images which are intrinsically intended to be shown by the use of machines or devices such as projectors, viewers, or electronic equipment (e.g., VCRs, computers, or DVD players) together with accompanying sounds, regardless of the nature of the material object, such as films, tapes, or memory devices, in which the literary work is embodied. For present purposes, however, "literary works" are limited in that they must describe a sequence of fictional or non-fictional events. In this regard, "literary works" would not include, for example, "cue cards" and the like that fail to describe a sequence of fictional or non-fictional events.

Like book 110 discussed with regard to FIG. 1A, movie 180 includes carefully selected phrasing or words, that is, movie 180 includes a number of phrases, some of which are triggering phrases (not shown) and others that are non-triggering phrases (also not shown). Combined, the triggering phrases and the non-triggering phrases form at least a part of a story told in the movie, in that they join to describe a sequence of fictional or non-fictional events. While movie 180 is played, triggering phrases 150 and non-triggering phrases 160 are incidentally broadcast to interactive plush toy 190. Interactive plush toy 190, in accordance with one embodiment of the present invention, is configured to respond to the triggering phrases it receives while movie 180 is being played. In certain embodiments, the response activated by the triggering phrases are based, at least in part, by the location of the triggering phrases relative to other triggering phrases in movie 180 or by the location of the triggering phrases relative to one or more of non-triggering phrases in movie 180.

Figure 2:
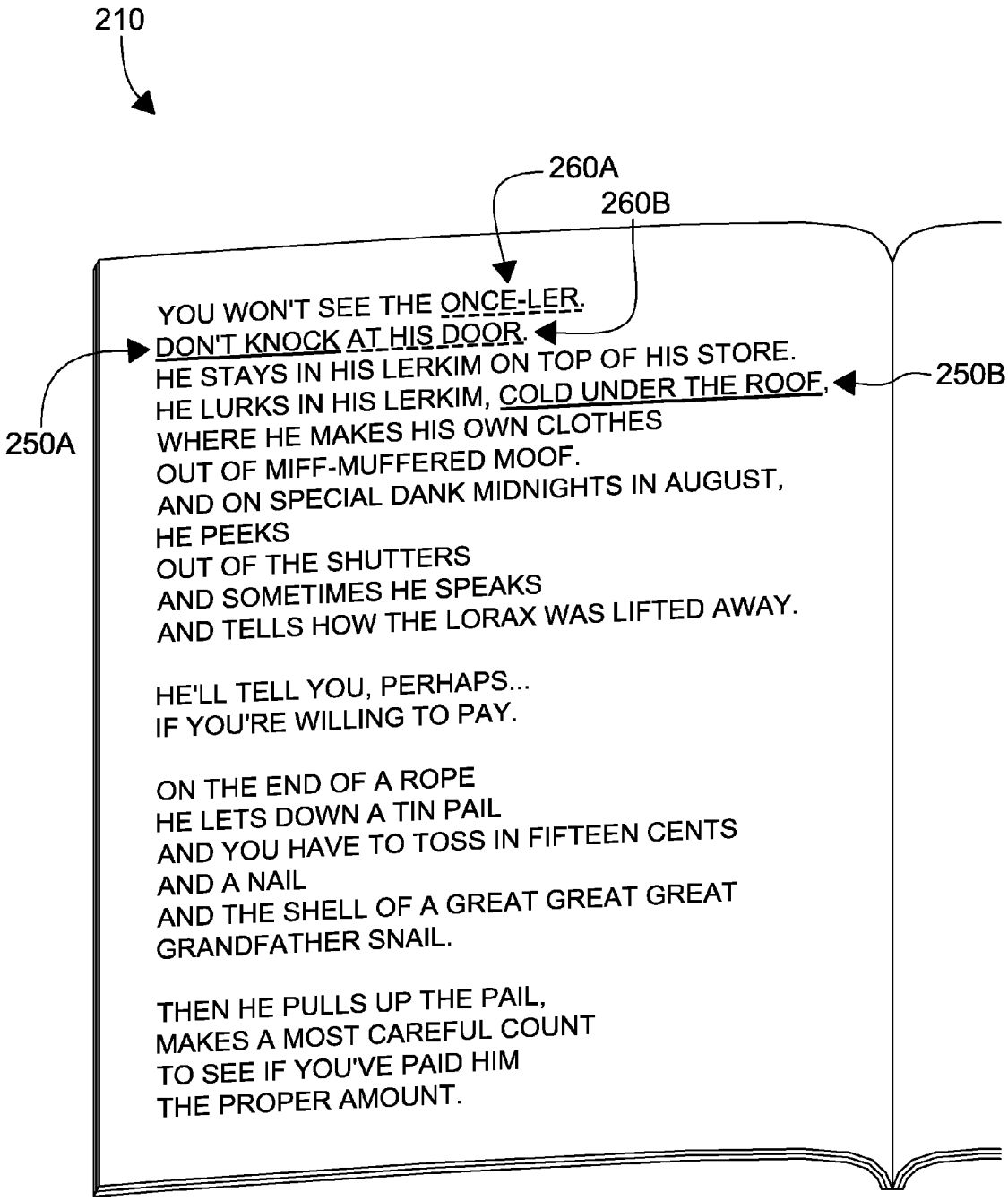

Turning now to FIG. 2, an exemplary configuration of book 110 is discussed. This exemplary configuration is denoted as book 210. As previously stated, book 210 includes a number of phrases, some of which are triggering phrases 250. The location of triggering phrases 250 are selectively positioned among other phrases, such as non-triggering phrases 260, such that they are more readily detectable by a speech recognition unit (not shown) in interactive plush toy 120 of system 100A (for clarity, the exemplary triggering phrases 250 of FIG. 2 are underlined with a solid line and the non-triggering phrases 260 are underlined with a dashed line). In accordance with one embodiment of the present invention, triggering phrase 250*a* may be selectively placed among a first non-triggering phrase 260*a* and a second non-triggering phrase 260*b*. In this example, the triggering phrase 250*a* ("don't knock") is placed after a first non-triggering phrase 260*a* ("once-ler"), at the beginning of a sentence, and before a second non-triggering phrase 260*b* ("at his door"). In other examples in accordance with alternate embodiments of the present invention, triggering phrases 250 may be embedded at the end of a sentence or within a clause of a sentence (such as a clause setoff by commas). Moreover, one or more triggering phrases 250 could optionally be placed at the end of a page of a book (or, at the end of a sentence at an end of a page of the book). For instance, in FIG. 2, triggering phrase 250*b* ("cold under the roof") is a triggering phrase embedded within a clause of a sentence. The sentence describes a sequence of fictional or non-fictional events and forms at least a part of the narrative or story told in book 210. This selective placement ensures that, as the book is read, a natural breaking or pause point occurs before and/or after the user reads aloud one or more triggering phrases 250 of book 210.

Embodiments of the present invention also include selecting the words or phrases in a non-triggering phrase such that the non-triggering phrase is sufficiently contrasted from a triggering phrase. In this embodiment, non-triggering phrases with similar phonemes (i.e., elemental units of spoken language) as triggering phrases can be rewritten or removed to minimize the incidence of false positives (i.e., improper detections of triggering phrases). For example, a triggering phrase "Jingle even loved to sing" could be combined with two preceding non-triggering phrases "Jingle loved to say hello" and "Jingle loved to fetch." In this combination, the triggering and non-triggering phrases combine to read "Jingle loved to say hello. Jingle loved to fetch. Jingle even loved to sing." Because "loved to say hello" is similar, in at least one phoneme, to "loved to sing," this combination could increase the incidence of improper triggering phrase detections. As such, the entire combination could be selectively rewritten to read "Jingle loved to bark hello. Jingle loved to fetch. Jingle even loved to sing." Alternatively, it could be redrafted to read "Jingle loved to fetch. Jingle even loved to sing." In this embodiment, the phonemes of the triggering phrases and the non-triggering phrases are selected to contrast with one another.

Similar selective placement or drafting occurs when triggering phrases 250 and non-triggering phrases 260 are embedded in literary work of a different medium, such as, for example, a movie on a DVD. In this embodiment, the script of the movie (which corresponds to the text of the book) comprises both triggering (not shown) and non-triggering phrases (not shown). While the movie is played, the story of the movie is naturally advanced as time progresses. Incidental to this process, certain triggering phrases are uttered by the characters or other participants in the story being told (e.g., a narrator, and so on). These triggering phrases are optionally embedded within the script in accordance with the methodologies generally disclosed herein, such as, for example, those discussed above with regard to FIG. 2.

Figure 3A:
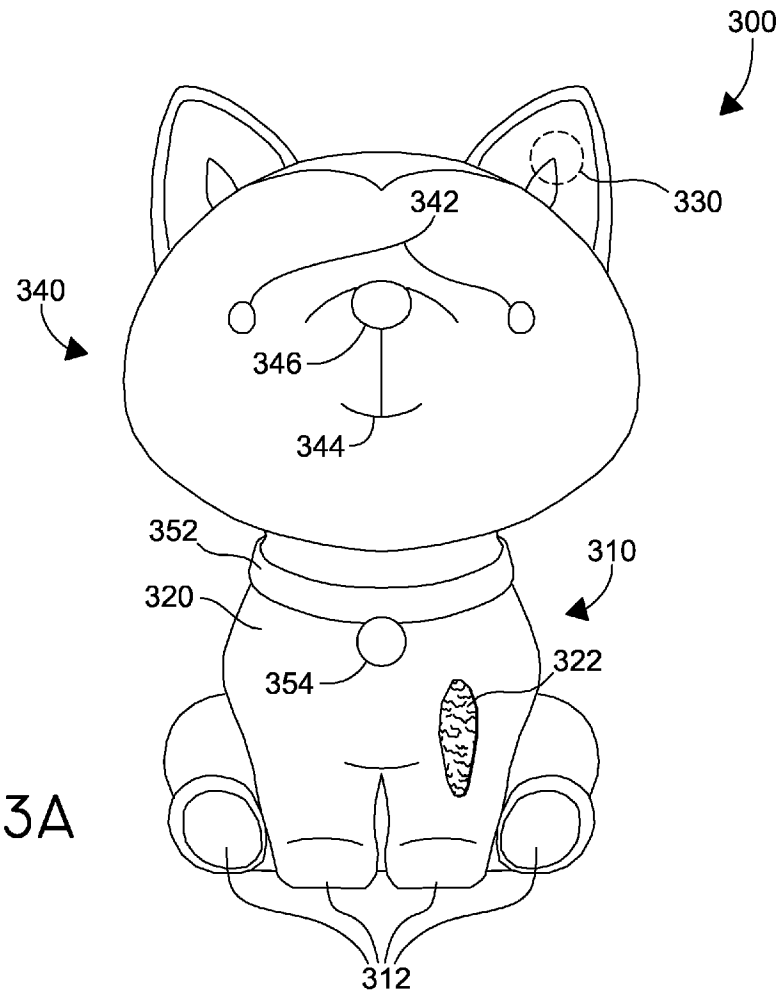
FIG. 3A is a front perspective view of the interactive plush toy of FIGS. 1A and 1B with some of the exterior features of the toy addressed.

Turning now to FIG. 3A, an exemplary construction of interactive plush toy 300 will now be provided. Interactive plush toy 300 can be of any material or construction, but in the illustrative embodiment disclosed herein, interactive plush toy 300 is a plush toy having a body 310 with a soft, furry exterior 320 and is filled with stuffing 322. In one embodiment, interactive plush toy 300 includes a user engagable switch 330. User engagable switch 330 is used for powering on the toy, such that, when user engagable switch 330 is engaged, interactive plush toy 300 is powered on. In the illustrated embodiment, user engagable switch 330 is located under the furry exterior 320, such as, for example, in the ear of interactive plush toy 300. In other embodiments, user engagable switch 330 can be located anywhere, such as, for example, on the furry exterior 320 or on the bottom of body 310. Interactive plush toy 300 includes a head 340, which may optionally include a pair of eyes 342, a mouth 344, and/or a nose 346. Body 310 of interactive plush toy 300 may also include a plurality of limbs 312. It should be understood that "limb" as used herein can mean leg or arm, but should also be understood in its broadest sense to mean any outwardly extending portion of interactive plush toy 300 (e.g., ears, tails, and the like). Interactive plush toy 300 may optionally include any number of other ornamental flourishes, such as, for example, a collar 352, a tag 354, a bell (not shown), and so on. In other embodiments, additional features may be optionally incorporated into interactive plush toy 300, such as, for example, lighting devices (not shown) or vibrating devices (also not shown). For instance, in some embodiments, head 340 may shake or nod or the bell (not show) may be configured to light up.

Figure 3B:
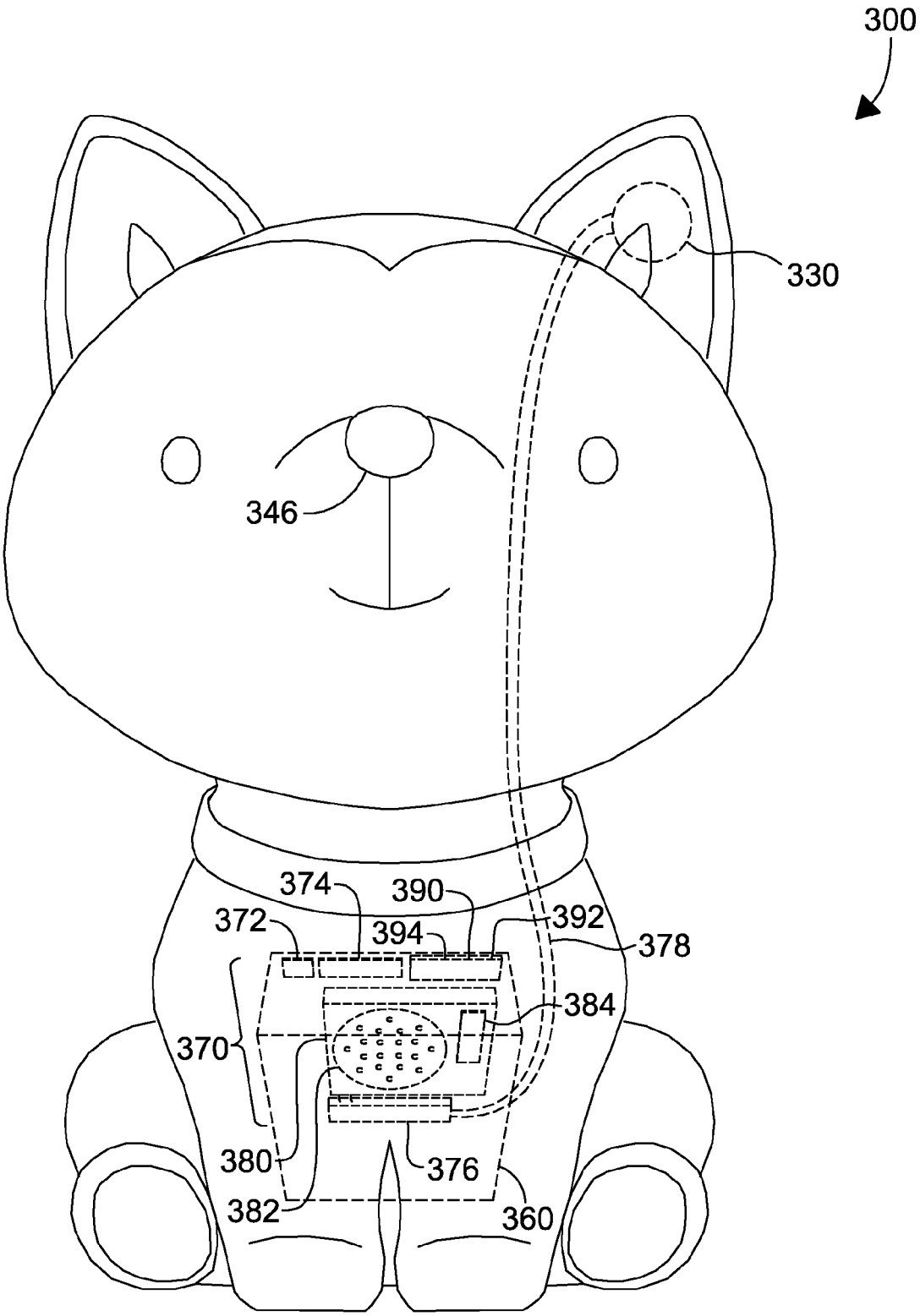
FIG. 3B is a front perspective view of the interactive plush toy of FIGS. 1A and 1B with some of the interior features of the toy addressed.

Referring now to FIG. 3B, interactive plush toy 300 may optionally include an interior cavity 360 housing a number of electrical components 370. Electrical components 370 are configured such that interactive plush toy 300 can play audible messages to interact with the user (not shown) of interactive plush toy 300. Exemplary electrical components 370 include, but are not limited to, a processor 372, a memory 374, a power supply 376, a sound module 380, and/or a speech recognition unit 390. In some implementations, any two or more of these electrical components 370, including sound module 380 and speech recognition unit 390, can be physically combined into a single device. In one potential implementation, sound module 380 and speech recognition unit 390 are combined into one device that performs the functionality of either or both of these components. Any number of other electrical components are contemplated, such that a full interactive effect may be realized by the user. Memory 374 could include any computer-readable media operable to store data or information and, thus, could comprise Random Access Memory ("RAM"); Read Only Memory ("ROM"); Electronically Erasable Programmable Read Only Memory ("EEPROM"); flash memory; and so on. In some embodiments, memory 374 is removable such that it can be replaced, updated, or changed by the user to accommodate new or updated literary works. In other embodiments, the new memory is distributed with a literary work, such as, for example, a new book or movie.

In the illustrative embodiment provided in FIG. 3B, power supply 376 includes one or more batteries (not shown) positioned in interior cavity 360 for powering one or more of electrical components 370. For example only, the one or more batteries (not shown) may be positioned in a battery compartment (not shown) that forms a part of a battery housing (not shown). Power supply 376 is electrically coupled to user engagable switch 330, such that, when user engagable switch 330 is engaged by the user (not shown), electrical power is delivered to one or more of electrical components 370. User engagable switch 330 and power supply 376 may be electrically coupled via one or more wires 378. In other embodiments, user engagable switch 330 optionally activates a "listening" mode (i.e., a standby mode). In this embodiment, user engagable switch does not fully control power supply 376. Rather, in this embodiment, one or more additional activation devices (e.g., switches, buttons, and so on; not shown) control the delivery of electrical power to one or more of electrical components 370, In this embodiment, the "listening" mode includes, for example, a current being delivered to one or more of electrical components 370 preparing for activation of user engagable switch 330.

In an embodiment, sound module 380 may be at least partially positioned within interior cavity 360 of body 310 and electrically coupled with power supply 376 by one or more wires 378. Sound module 380 preferably includes a speaker 382, a sound module controller 384, and various related circuitry (not shown). The related circuitry may work with the sound module controller 384 to activate speaker 382 and to play audio messages stored in sound module controller 384 or in memory 374 in a manner known to one of ordinary skill in the art. In one embodiment, processor 372 is used by sound module 380 and/or related circuitry to play the audio messages stored in sound module controller 384 and/or memory 374. In other embodiments, this functionality is performed solely by the related circuitry and sound module controller 384.

Speech recognition unit 390 may also be positioned within interior cavity 360 of body 310 and electrically coupled with power supply 376 by one or more wires 378. Speech recognition unit 390 preferably includes an input device 392, a speech recognition unit controller 394, and other related circuitry (not shown). An exemplary input unit 392 could include a microphone or other sound receiving device (i.e., any device that converts sound into an electrical signal). Speech recognition unit controller 394 may include, for example, an integrated circuit having a processor and a memory (not shown). Input device 392, speech recognition unit controller 394, and the other related circuitry, are configured to work together to receive and detect audible messages from a user or sound source (not shown). For example, speech recognition unit 390 may be configured to receive audible sounds from a user or other source and to analyze the received audible sounds to detect triggering phrases. Alternatively, speech recognition unit 390 may be configured to receive audible sounds from a user or other source and to analyze the received audible sounds to detect a sequence of triggering phrases and/or non-triggering phrases. Based upon the detected triggering phrase (or each detected sequence of triggering phrases and/or non-triggering phrases), an appropriate interactive response may be selected. For example, for each detected triggering phrase (or the detected sequence of triggering phrases and/or non-triggering phrases), a corresponding response may be stored in a memory 374 or in speech recognition unit controller 394. Speech recognition unit 390 may employ at least one speech recognition algorithm that relies, at least in part, on laws of speech or other available data (e.g., heuristics) to identify and detect triggering phrases, whether spoken by an adult, child, movie, or so on. As would be appreciated by those of ordinary skill in the art, speech recognition unit 390 may be configured to receive incoming audible sounds (such as audible messages) and compare the incoming audible sounds to expected phonemes stored in speech recognition unit controller 394 or other memory device (such as, for example, memory 374). For example, speech recognition unit 390 may parse received speech into its constituent phonemes and compare these constituents against those constituent phonemes of one or more triggering phrases. When a sufficient number of phonemes match between the received audible sounds and the triggering phrase or phrases), a match is recorded. When there is a match, speech recognition unit 390, possibly by speech recognition unit controller 394 or the other related circuitry, activates the appropriate responsive program, such as, for example, the appropriate sound or action response.

Continuing with FIG. 3B, in one embodiment, nose 346 of interactive plush toy 300 is constructed of the same or similar material or construction as furry exterior 320. In another embodiment, however, nose 346 is made of a different material or construction, such as, for example, any suitable polymer (e.g., polypropylene, polyurethane, polycarbonate, polyethylene, and so on). In any embodiment, the nose 346 may be perforated, such that a portion of speech recognition unit 390 (or sound module 380) can be positioned behind the exterior of the nose 346. For example, input device 392 can be optionally positioned behind nose 346. In this implementation, speech recognition unit 390 is better able to receive and detect audible sounds because there is less interference from intervening objects, such as, for example, furry exterior 320 or stuffing 322. In another embodiment, speaker 382 of sound module 380 may be positioned behind the exterior of the nose 346. In another embodiment, both input device 392 and speaker 382 are positioned behind nose 346 or any other natural or designed aperture (or series or set of apertures). In still a different embodiment, one or more of these devices, such as input device 392, resides outside interactive plush toy 300 entirely, and is optionally incorporated into the companion literary work.

Interactive plush toy 300 may also include a number of other elements that are not illustrated in either FIG. 3A or 3B. Indeed, interactive plush toy 300 may include a number of light elements, such as for example, one or more light-emitting diodes ("LEDs") (not shown) or incandescent light bulbs (not shown). Likewise, interactive plush toy 300 may include one or more mechanical members (not shown) to be used in conjunction with an activated responsive program, such as, for example, mechanical members that facilitate a vibration or dancing program. Any number of other elements are optionally included, such that each embodiment of the present invention may be realized.

Figure 4A:
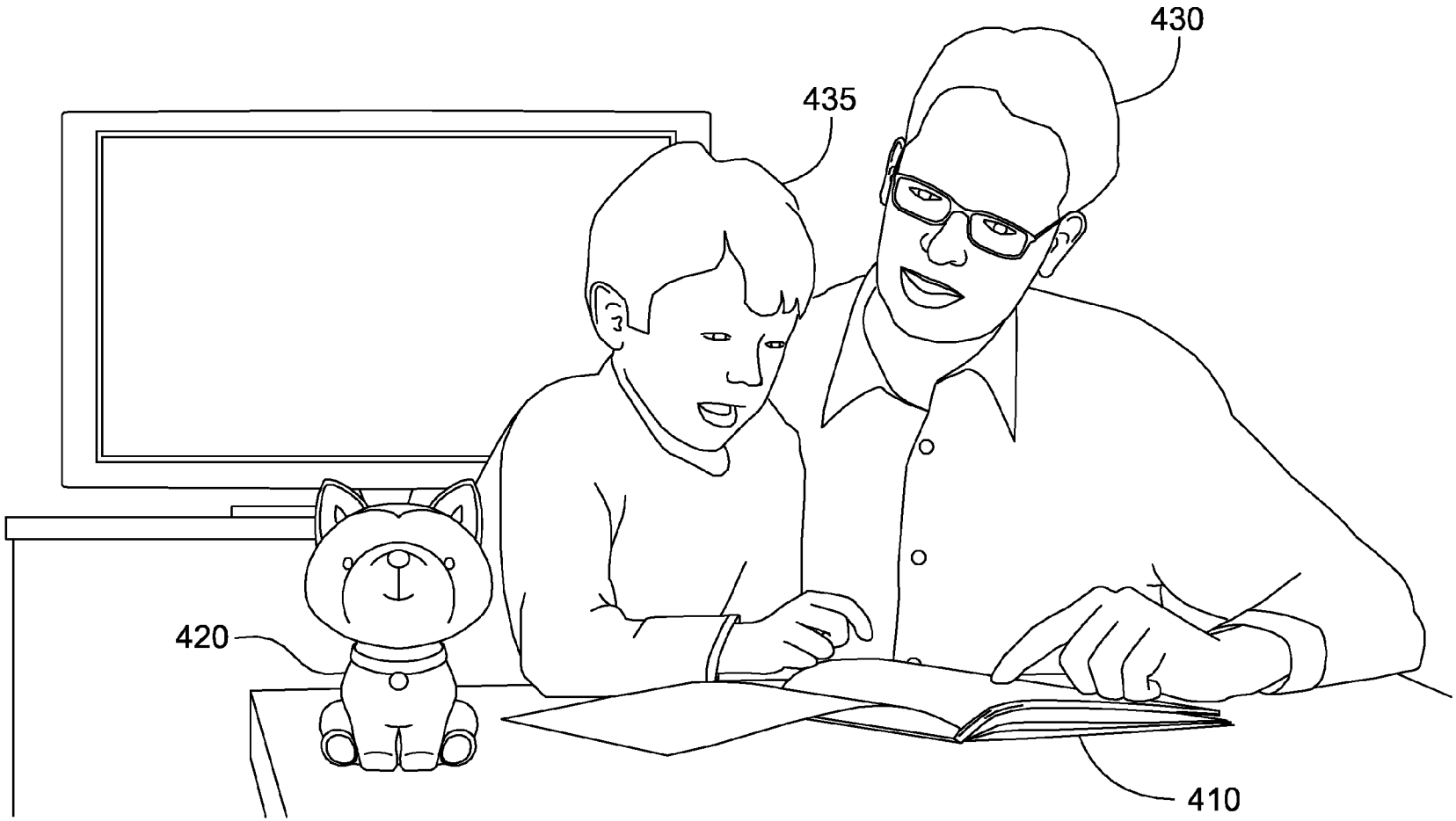
FIG. 4A is an illustration of one implementation of the present invention in which a father is reading a book to his child.
Figure 4B:
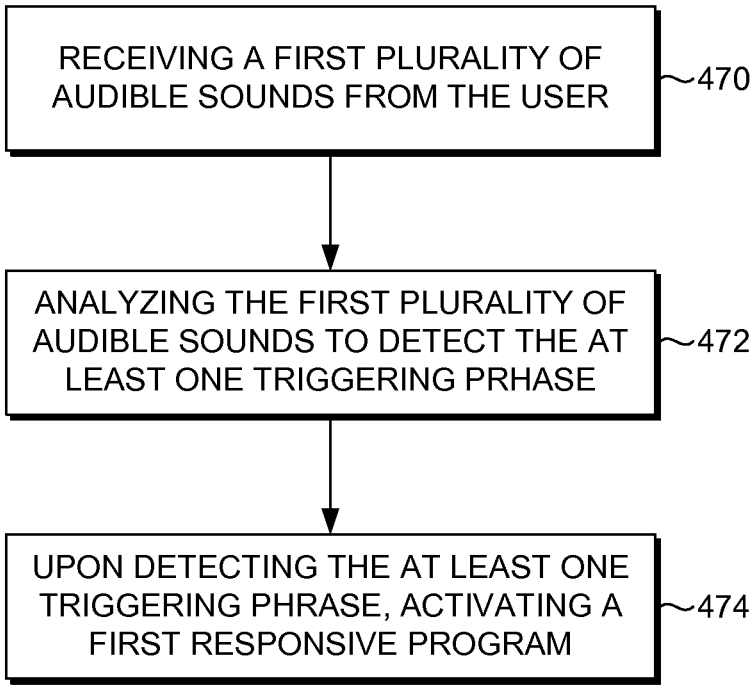
FIG. 4B is an excerpted flow diagram illustrating one exemplary method of interacting with a user.
Figure 4C:
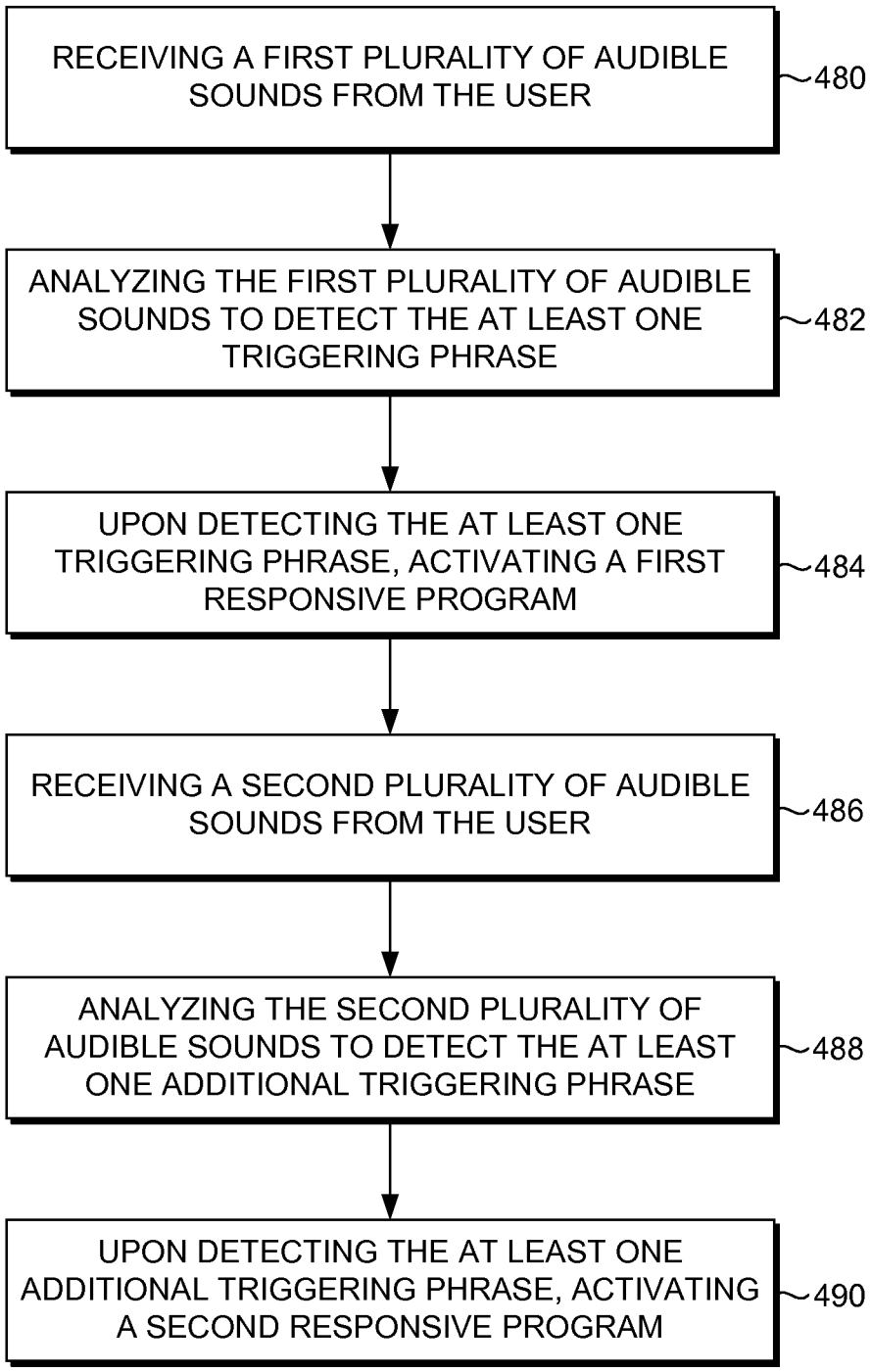
FIG. 4C is an excerpted flow diagram illustrating another exemplary method of interacting with a user.

Turning now to FIGS. 4A, 4B, and 4C, several exemplary embodiments of the present invention will now be addressed. As illustrated in FIG. 4A, a user 430 is reading a book 410 to a child 435 in accordance with one feature of the present invention. As previously explained with regard to FIG. 1, book 410 includes a number of phrases, some of which are triggering phrases (not shown) and some of which are non-triggering phrases (not shown). When combined, however, triggering phrases and the non-triggering phrases form part of the story told in book 410. Thus, when user 430 reads the story told in book 410, user 430 incidentally reads both triggering phrases and non-triggering phrases. In one embodiment, user 430 does not know which phrases are triggering phrases and which are not because triggering phrases are not identified as such in book 410. Alternatively, in a different embodiment, user 430 can identify which phrases are triggering phrases because, in this example, triggering phrases are marked or otherwise identified to the user (e.g., underlined, highlighted, shown in a different color, italicized, raised text, and so on). Thus, an implementation of the present invention becomes clear. User 430 reads from book 410 to child 435. Book 410 includes some story or narrative of interest to the child 435. As user 430 reads the story told in book 410, certain triggering phrases are incidentally read aloud. As user 430 reads the story told in book 410, and incidentally reads triggering phrases embedded therein, interactive plush toy 420 is configured to respond to triggering phrases as they are read aloud. This process is more fully described in FIG. 4B.

Turning to FIG. 4B, an exemplary method in accordance with one embodiment of the present invention is disclosed. At step 470, a toy, such as interactive plush toy 420, receives a first set of audible sounds from a user. The first set of audible sounds corresponds to the text of a book, such as book 410, as the book is read aloud by a user. In one embodiment, the audible sounds include the voice of the user as the user reads the book aloud. In other embodiments, however, the audible sounds may be received from any source, such as, for example, a child. In the latter embodiment, the book, such as book 410, may instruct the user or the child to read or recite certain phrases in the book, such as, for example, certain triggering or non-triggering phrases. The audible sounds received by the toy, such as interactive plush toy 420, correspond to text read aloud from the book that contains any number of triggering phrases and any number of non-triggering phrases. When read together, the triggering and non-triggering phrases form a narrative in the book, such as book 410, that describes a sequence of fictional or non-fictional events. For example, the triggering and non-triggering phrases can combine to tell the story of a little dog that behaves very well.

Thereafter, at step 472, the toy analyzes the first set of audible sounds. The first set of audible sounds is analyzed to detect a first phrase, such as, for example, a triggering phrase. This triggering phrase can be any phrase that forms a part of the story told in the book. The toy, such as interactive plush toy 420, then detects whether the received audible sounds correspond to at least one of the triggering phrases embedded in the book. The toy, such as interactive plush toy 420, compares the audible sounds to a list of triggering phrases stored in a controller (such as speech recognition unit controller 394 discussed in FIG. 3B) or a memory (such as memory 374 discussed in FIG. 3B). In one embodiment, the speech recognition unit receives audible sounds and divides them into phonemes. In this embodiment, the phonemes of the received audible sounds are compared against the phonemes of the programmed triggering phrases to detect a match. When a match is made, a controller device (such as speech recognition unit controller 394, discussed above at FIG. 3B) determines which responsive program should be activated and activates that responsive program. In this implementation, because phonemes are compared, the speech recognition unit does not discriminate on the bases of pitch and/or tempo. In this regard, embodiments of the present invention are suited for any sound source, such as, for example, an adult's voice, a child's voice, or even a character in a movie. It should be noted, however, that other speech recognition technologies are contemplated within the scope of the present invention, such as, for example, sound frequency and/or amplitude-based speech recognition algorithms.

When a triggering phrase is detected, at step 474, the toy, such as interactive plush toy 420, activates a responsive program. The responsive program can take many forms, such as, for example, an audio file, a mechanical program (e.g., a dancing program, a vibration program, and so on), a lighting program, and the like. In one embodiment, the potential responsive programs supplement or augment the narrative or story being told in the literary work. For example, the triggering phrase read aloud from the book may include a reference to a "dog barking real loud." Upon detection of this phrase, the method discussed in FIG. 4B activates a pre-programmed responsive program, such as, for example, an audio file of a dog barking. For further illustration, the triggering phrase read aloud from the book may include a reference to a dog that "is really, really cold." When this potential triggering phrase is detected by a toy dog, such as interactive plush toy 420, the toy dog can activate a movement program, wherein all or part of the toy dog moves. For example, the movement program may include a vibration sequence, in which all or part of the dog vibrates. The vibration sequence supplements or augments the story because it appears to user 430 that the toy is shivering because it "is really, really cold."

In another embodiment, the responsive program may comprise data or information. The data or information responsive program may be activated alone or in combination with any other responsive program, such as, for example, an audio file or a movement program. The data or information may optionally be displayed to the user or communicated to another device or set of devices. Communication of information or data may be through any standard communication method or means, including, for example only, wired or wireless. Wired configurations optionally include serial wiring, firewire, USB, and so on. Wireless configurations optionally include any radio frequency communication technique, Wi-Fi, bluetooth, and so on. In these exemplary implementations, the data or information may optionally be used by the receiving device or devices in a manner consistent with embodiments of the inventions, such as, for example, to supplement the story being told, to activate a responsive program, and so on.

Likewise, the triggering phrase read aloud from the book could mention the "bright red nose of the reindeer." Upon detecting this phrase, for example, a light program could be activated in which the nose of the toy (in this case, a toy reindeer) lights up (e.g., turns red). The light program supplements or augments the narrative of the story because the lighting program occurs substantially simultaneously as the text is read aloud, appearing, to the user, to occur in response to the reading of the whole story. Other potential responsive programs, such as moving limbs and so on, are contemplated within the scope of the present invention. The prior recitation of examples should in no way be construed as limiting. For example, a number of responsive programs could, optionally, be activated in response to a single triggering phrase.

The process described in FIG. 4B may optionally be expanded to include additional iterations. One such iteration is explained in FIG. 4C. As shown in FIG. 4C, the process begins much as the process illustrated in FIG. 4B. Namely, at step 480 the step described in FIG. 4B (step 470) is performed. That is, a toy, such as interactive plush toy 420, receives a first set of audible sounds from a user. Thereafter, at step 482 of FIG. 4C, the toy analyzes the first set of audible sounds to detect a first phrase, such as, for example, a triggering phrase. When a first triggering phrase is detected, at step 484, the toy, such as interactive plush toy 420, activates a responsive program. All of these steps were explained above, with regard to FIG. 4B.

Continuing on, at step 486, the toy, such as interactive plush toy 420, receives a second set of audible sounds from the user. The second set of audible sounds may also correspond to the text of a book, such as book 410, as the book is read aloud by a user. Much like the embodiments discussed above, the second set of audible sounds may include the voice of the user or may be received from any source, such as, for example, a child. When read together, the triggering and non-triggering phrases form a narrative in the book, such as book 410, that describes a sequence of fictional or non-fictional events. Because the user has continued to read the book, the second set of audible sounds contains triggering and non-triggering phrases that combine to continue the narrative in the book formed by the first set of triggering and non-triggering phrases. For example only, the second set of audible sounds may expand on the story of the well-behaved dog discussed above.

Much like step 474 addressed above, at step 488, the toy analyzes the second set of audible sounds to detect a second phrase, such as, for example, a second triggering phrase. In certain embodiments, the first triggering phrase and the second triggering phrases are different, but that it not required. On the contrary, the triggering phrases may be the same and may be differentiated with reference to non-triggering phrases and/or other triggering phrases For example, a triggering phrase could be the phrase "Jingle is a good dog." In the first occurrence of this triggering phrase, the phrase could be embedded at the beginning of a sentence and followed by the non-triggering phrase "Or so we thought." In this example, the combination of the triggering phrase and the non-triggering phrase would be "Jingle is a good dog. Or so we thought." In this implementation, the triggering phrase "Jingle is a good dog" may correspond to a responsive program programmed in an interactive plush toy dog, such as, for example, an audio file of a dog whimpering or a mechanical response in which the toy dog cowers (lowers its head). In contrast, the same triggering phrase could be combined with a non-triggering phrase "Jingle ran right inside. Indeed," to form "Jingle ran right inside. Indeed, Jingle is a good dog." Here, the corresponding responsive program may include activating an audio file of a dog barking happily or a mechanical response in which the toy dog wags its tail. In this regard, embodiments of the present invention contemplate not only detecting whether the received audible sounds correspond to at least one of the triggering phrases embedded in the book, but also applying context-based rules to detect a triggering phrase and activate the appropriate response. These rules can be stored in a memory (such as memory 374, discussed with regard to FIG. 3B) or a controller (such as, for example, speech recognition unit controller 394 discussed above). In other embodiments, context-based rules may include, for example, the previously received triggering or non-triggering phrases or the previously activated responsive programs. That is, the response activated upon the detection of a second triggering phrase can be based, at least in part, on the response activated upon detect of a first triggering phrase or, for that matter, the actual occurrence of the first triggering phrase.

Upon detecting the second triggering phrase, at step 490, the toy then activates a second responsive program. The second responsive program further supplements or augments the narrative in the book. In one embodiment, the second responsive program is of a different kind than the first responsive program, such as, for example, an audio file versus a vibration program. In other embodiments, however, the responsive programs are optionally of the same kind (e.g., both audio files). In still other embodiments, the first triggering phrase and the second triggering phrase each correspond to a number of potential responsive programs. For instance, a particular triggering phrase may correspond with three potential responsive programs. The second triggering phrase may also correspond with three potential responsive programs. In this embodiment, however, both the first triggering phrase and the second triggering phrase only correspond to one shared or common responsive program. Thus, when this sequence of triggering phrases is received and detected by a device, only one responsive program satisfies both triggering phrases. In this example, the shared or common responsive program is then activated in accordance with the procedures previously discussed.

The process described above can be repeated as many times as necessary, such as, for example, a third or a fourth time. Each time, the supplemental audible sounds correspond with text from the book and the supplemental triggering and non-triggering phrases combine to continue the narrative told in the book. As this process repeats, certain determination or detections may need to be stored (such as, for example, in sound module controller 384 or memory 374 discussed in FIG. 3B). When subsequent detections are made, these store results may be activated or called by the processor (such as processor 372 discussed in FIG. 3B) or a controller (such as sound module controller 384 or speech recognition unit controller 394 discussed in FIG. 3B). Thus, the embodiments of the present invention include applying previously-detected or received triggering phrases and/or non-triggering phrases to determine the appropriate response to any subsequently-occurring response, as previously described. Moreover, each triggering phrase can correspond with a number of potentially responsive programs and, as additional triggering phrases are received and detected, the toy can update the list of potential responsive programs that remain. When only one potentially responsive program applies to all of the triggering phrases, that responsive program may be activated, at such a time or place when it is appropriate and supplements the story being told.

In this regard, embodiments of the present invention encompass interchangeable literary works. That is, certain triggering phrases in a first literary work could elicit a particular response, depending on the arrangement of the triggering phrases (and non-triggering phrases) in the first literary work. In contrast, a different arrangement of these and other triggering phrases (and non-triggering phrases) could elicit a different series or sequence of responsive programs. Thus, the toys of the present invention can be programmed once and used with a number literary works.

Figure 5A:
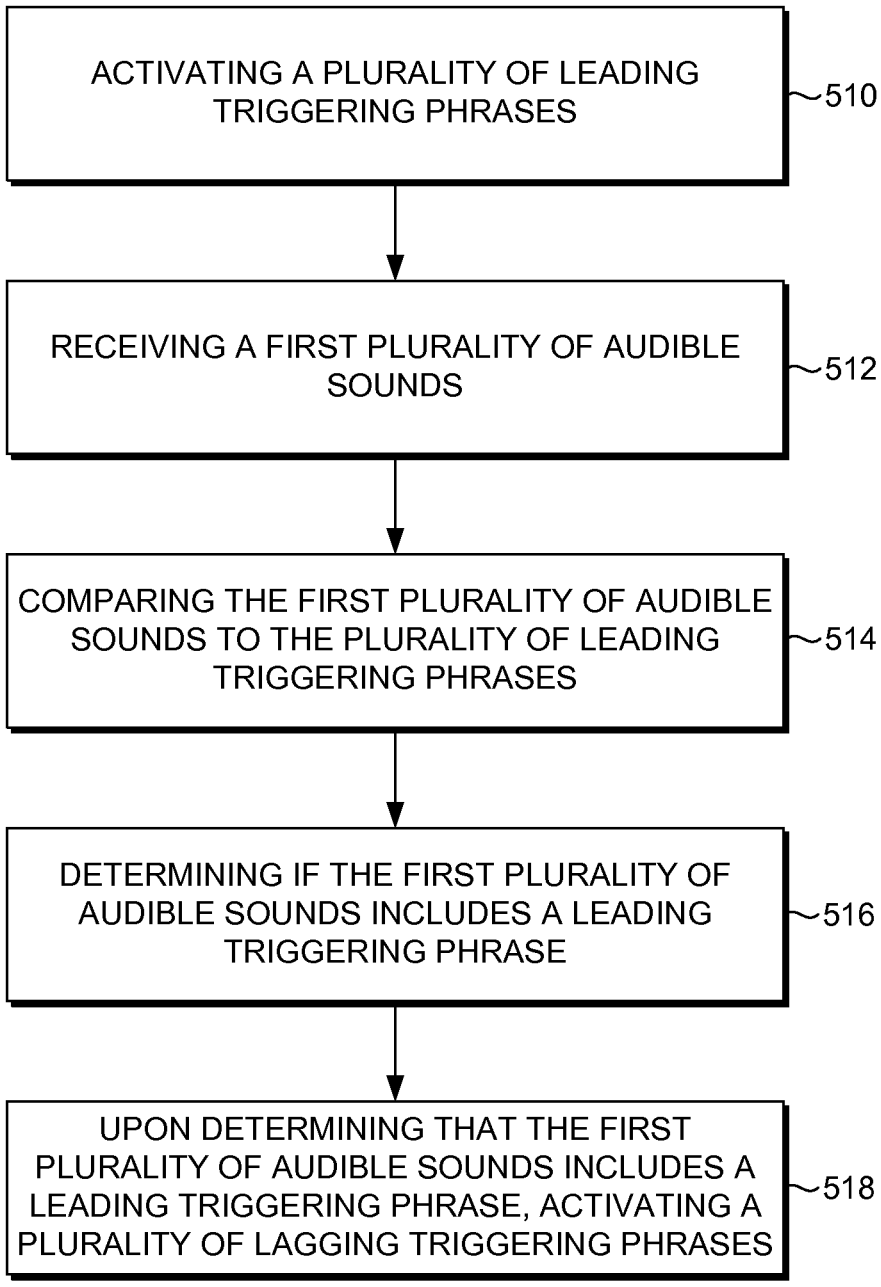
FIG. 5A is an excerpted flow diagram illustrating an exemplary method of activating triggering phrases from a memory to facilitate user interaction.

Some of the processes described above with regard to FIGS. 4A, 4B, and 4C will now be discussed in greater detail with regard to FIG. 5A. In FIG. 5A, a method of interacting with a user according to one embodiment of the present invention is illustrated. In this embodiment, at step 510, a computer program or application activates or calls a number of "leading triggering phrases." A leading triggering phrase is a triggering phrase that precedes another triggering phrase (e.g., a "lagging triggering phrase") that, when combined with the other triggering phrase, combines to define a unique program or response. The leading triggering phrase may have significance on its own, such as, for example, corresponding to a particular responsive program (e.g., an audio file played when the leading triggering phrase is received and detected). Alternatively, the leading triggering phrase may have no significance independent of one or more additional triggering phrases. In the latter embodiment, it is the combination of the leading triggering phrase with the lagging triggering phrase that defines the appropriate response. The leading triggering phrase can combine with any number of lagging triggering phrases, wherein any such combination can define a responsive program unique to that leading triggering phrase and lagging triggering phrase combination. Likewise, a leading triggering phrase may need to be combined with any number of lagging triggering phrases to acquire significance, for example, to define a responsive program. Thus, one leading triggering phrase could, for example, combine with two lagging triggering phrases to define a responsive program wherein a toy dog closes its eyes and pretends to go to sleep.

Figure 5B:
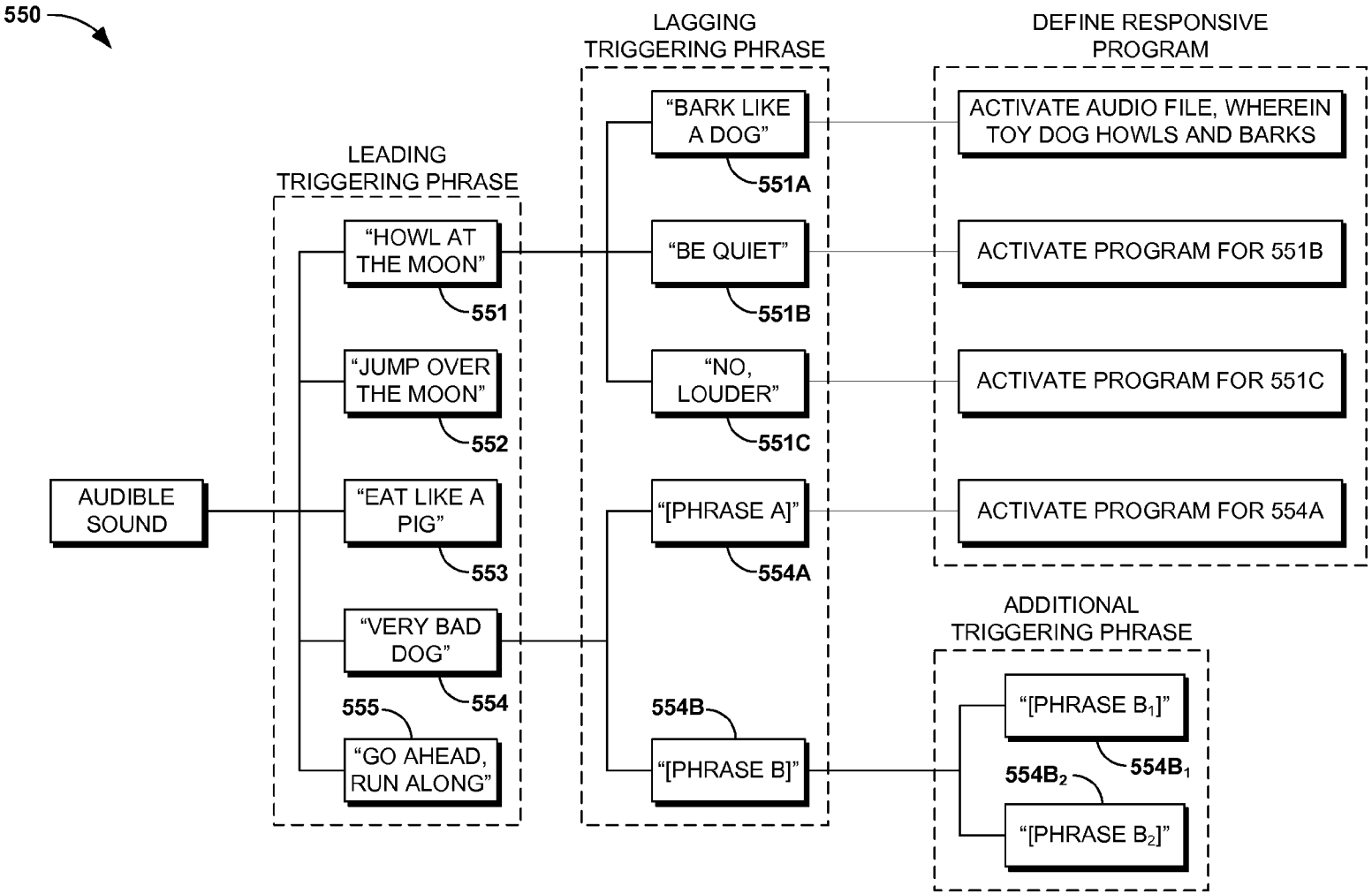
FIG. 5B is an excerpted diagram of embodiments of the present invention illustrating the relational programming of leading triggering phrases and lagging triggering phrases.

This feature of an embodiment of the present invention is generally illustrated in FIG. 5B. As shown in FIG. 5B, embodiments of the present invention include programming a number of leading triggering phrases 550 into a device, such as an interactive plush toy (for clarity, only a few potential options are illustrated in FIG. 5B). For example, leading triggering phrase 551 is "Howl at the moon." Leading triggering phrase 551 can have independent significance (e.g., activates a responsive program, such as, a dog howling at the moon) or may acquire significance only when a lagging triggering phrase, such as lagging phrases 551A, 551B, and 551C are received. Indeed, if, after leading triggering phrase 551 is received and detected, lagging triggering phrase 551A ("Bark like a dog") is detected, a different responsive program may be activated. In the example provided in FIG. 5B, this includes activating an audio file that includes a dog howling and barking at the moon. Other leading and lagging phrase combinations, such as 554 and 554B, may not define a responsive program and require further triggering phrases, as illustrated.

Returning now to FIG. 5A, at step 512, audible sounds are received. These sounds can be received from any source, such as, for example, a user reading a book or from the voice of a character in a movie being played. Thereafter, at step 514, a comparison is made comparing the first set of audible sounds to the activated or called leading triggering phrases. At step 516, a determination is made to determine whether the set plurality of audible sounds included one or more of the activated or called leading triggering phrase. This process has been described above, but generally applies laws of speech and speech recognition algorithms to differentiate and detect a pre-programmed triggering phrase. At step 518, a determination is made that the set of audible sounds did include at least one leading triggering phrase. Upon making this determination, a number of lagging triggering phrases are activated or called, and the process may repeat. That is, when a lagging phrase is received and detected, it may, along with the previously received and detect leading triggering phrase, define an interactive response. For example, in FIG. 5B, leading triggering phrase 551 combines with lagging triggering phrase 551B to define a unique responsive program (e.g., an audio file that supplements or augments the story from both triggering phrases).

From the foregoing it will be seen that this invention is one well adapted to attain all ends and objects hereinabove set forth together with the other advantages which are obvious and which are inherent to the method and apparatus. It will be understood that various modifications can be made and still stay within the scope of the invention. For example, instead of being an interactive plush toy dog, the interactive plush toy could be a cat, a reindeer, a goat, or any other animal or even a person/character. Instead of being plush, the interactive toy could be constructed of any material. It will also be understood that certain features and subcombinations are of utility and may be employed without reference to other features and subcombinations. This is contemplated by and is within the scope of the invention.

Since many possible embodiments may be made of the invention without departing from the scope thereof, it is to be understood that all matter herein set forth or shown in the accompanying drawings is to be interpreted as illustrative of applications of the principles of this invention, and not in a limiting sense.

What is claimed is:

1. An interactive toy comprising:

a body having an interior cavity;

a speech recognition unit at least partially positioned within the interior cavity, the speech recognition unit configured to receive audible sounds corresponding to a literary work and, to identify a combination of at least one triggering phrase and at least one non-triggering phrase in the audible sounds corresponding to the literary work, wherein the literary work comprises:

(1) a plurality of non-triggering phrases that form part of a story told in the literary work;

(2) a plurality of other words that are neither non-triggering phrases nor triggering phrases; and (3) the at least one triggering phrase that also forms part of the story told in the literary work, wherein the at least one triggering phrase is selectively placed among the plurality of other words that are neither non-triggering phrases nor triggering phrases and the plurality of non-triggering phrase to assist the speech recognition unit in differentiating the at least one triggering phrase from the other words a sound module at least partially positioned within the interior cavity, the sound module having a controller with a plurality of audio messages stored therein for selective playback via a speaker, wherein the sound module activates one or more messages if once the combination of the at least one triggering phrase and the at least one non-triggering phrase is received and identified by the speech recognition unit; and a user engagable switch for powering on the interactive toy.

2. The interactive toy of claim 1, wherein the literary work is a movie or a live broadcast.

3. The interactive toy of claim 1, wherein the literary work is a book.

4. The interactive toy of claim 1, wherein the at least one triggering phrase is selectively placed at an end of a sentence within the story told in the book.

5. The interactive toy of claim 1, wherein the at least one triggering phrase is selectively placed at the beginning of a sentence within the story told in the book.

6. The interactive toy of claim 1, wherein the at least one triggering phrase is selectively placed at an end of a sentence at an end of a page of the book.

7. The interactive toy of claim 1, wherein the at least one triggering phrase is selectively placed in a clause within a sentence within the story told in the book.

8. An interactive toy for responding to audible sounds corresponding to a literary work having a plurality of non-triggering phrases, at least one triggering phrase, and a plurality of other words that are neither non-triggering phrases nor triggering phrases, the at least one triggering phrase being selectively placed among the plurality of non-triggering phrases to assist the toy in differentiating a triggering phrase from one or more non-triggering phrases, the toy comprising:

a body having an interior cavity;

a speech recognition unit at least partially positioned within the interior cavity of the body, the speech recognition unit configured to receive audible sounds corresponding to the literary work and, to identify a combination of at least one non-triggering phrase and at least one triggering phrase in the audible sounds corresponding to the literary work;

a sound module at least partially positioned within the interior cavity of the body, the sound module having a controller with a plurality of audio messages stored therein for selective playback via a speaker, wherein the sound module plays back one or more messages if once the combination of the at least one non-triggering phrase and the at least one triggering phrase is received and identified by the speech recognition unit; and a user engagable switch for powering on the interactive toy.

9. The interactive toy of claim 8, wherein the literary work is a movie or a live broadcast, and wherein the at least one non-triggering phrase and at least one triggering phrase are stored in a memory in the toy.

10. The interactive toy of claim 8, wherein the literary work is a book and the at least one non-triggering phrase and at least one triggering phrase correspond to text in the book, and wherein the at least one non-triggering phrase and at least one triggering phrase are stored in a memory in the toy.

11. An interactive toy for responding to audible sounds corresponding to words read aloud from a book that form part of a story told in the book, the words including at least one non-triggering phrase, at least one triggering phrase, and a plurality of other words that are neither non-triggering phrases nor triggering phrases, the at least one triggering phrase being selectively placed among the plurality of other words that are neither non-triggering phrases nor triggering phrases and the at least one non-triggering phrase to assist the toy in differentiating the at least one triggering phrase from the other words, the toy comprising:

a body having an interior cavity;

a speech recognition unit at least partially positioned within the interior cavity of the body, the speech recognition unit configured to receive the audible sounds corresponding to the words read aloud from the book and to identify a combination of the at least one non-triggering phrase and the at least one triggering phrase in the audible sounds corresponding to the literary work;

a memory coupled with the speech recognition unit and having stored therein the at least one non-triggering phrase and the at least one triggering phrase;

a sound module at least partially positioned within the interior cavity of the body, the sound module having a controller with at least one audio message stored therein for selective playback via a speaker, wherein the sound module plays back the at least one message once the combination of the at least one non-triggering phrase and the at least one triggering phrase are received and identified by the speech recognition unit; and a user engagable switch for powering on the interactive toy.

12. The interactive toy of claim 11, wherein the sound module only plays back the at least one message upon receipt and identification of the at least on triggering phrase after previous receipt and identification of the at least one non-triggering phrase.

* * * * *

UNITED STATES PATENT AND TRADEMARK OFFICE

CERTIFICATE OF CORRECTION

PATENT NO. : 8,911,277 B2
APPLICATION NO. : 13/116927
DATED : December 16, 2014
INVENTOR(S) : Jennifer R. Garbos, Timothy G. Bodendistel and Peter B. Friedmann It is certified that error appears in the above-identified patent and that said Letters Patent is hereby corrected as shown below:

In the claims

Column 12, line 62 - Change “and, to” after “work” to --and to--;
Column 13, line 8 - Change “phrase” after “non-triggering” to --phrases--;
Column 13, line 10 - Change “other words a sound” to --other words;-- and start “a sound” on the next line at the same indention level as the next “a user” paragraph that follows it;
Column 13, line 15 - Change “messages if once” to --messages once--;
Column 13, line 24 - Change “claim 1” to --claim 3--;
Column 13, line 27 - Change “claim 1” to --claim 3--;
Column 13, line 30 - Change “claim 1” to --claim 3--;
Column 13, line 33 - Change “claim 1” to --claim 3--;
Column 13, line 48 - Change “and, to” after “work” to --and to--; and
Column 14, line 3 - Change “messages if once” to --messages once--.

Signed and Sealed this
Twenty-third Day of February, 2016

Michelle K. Lee

Michelle K. Lee
*Director of the United States Patent and Trademark Office*